US008677699B2

(12) United States Patent
Tagawa

(10) Patent No.: US 8,677,699 B2
(45) Date of Patent: Mar. 25, 2014

(54) VIBRATION CONTROL DEVICE FOR BEAM-AND-COLUMN FRAME

(75) Inventor: Hiroshi Tagawa, Nagoya (JP)

(73) Assignee: National University Corporation Nagoya University (JP)

( * ) Notice: Subject to any disclaimer, the term of this patent is extended or adjusted under 35 U.S.C. 154(b) by 59 days.

(21) Appl. No.: 13/260,204

(22) PCT Filed: Feb. 3, 2010

(86) PCT No.: PCT/JP2010/051472

§ 371 (c)(1),
(2), (4) Date: Oct. 28, 2011

(87) PCT Pub. No.: WO2010/116779

PCT Pub. Date: Oct. 14, 2010

(65) Prior Publication Data

US 2012/0038091 A1 Feb. 16, 2012

(30) Foreign Application Priority Data

Mar. 30, 2009 (JP) ..... 2009-081222

(51) Int. Cl.
*E04H 9/02* (2006.01)

(52) U.S. Cl.
USPC ..... 52/167.8; 52/167.3; 188/380; 267/136; 267/160

(58) Field of Classification Search
USPC ..... 267/136, 133, 160; 188/378–380; 52/167.1–167.9; 248/562, 628, 636, 248/638
See application file for complete search history.

(56) References Cited

U.S. PATENT DOCUMENTS 5,102,107 A * 4/1992 Simon et al. ..... 267/152
5,358,210 A * 10/1994 Simon et al. ..... 248/628

(Continued)

FOREIGN PATENT DOCUMENTS

JP 2003-90144 A 3/2003
JP 2004278205 A * 10/2004

(Continued)

OTHER PUBLICATIONS

National University Corporation Nagoya University et al., International Search Report and Written Opinion of the International Searching Authority (JPO) issued in the parent International Patent Application No. PCT/JP2010/051472.

*Primary Examiner* — Thomas J Williams
*Assistant Examiner* — Mariano Sy
(74) *Attorney, Agent, or Firm* — Jeffrey G. Sheldon; Sheldon Mak & Anderson

(57) ABSTRACT

A rotary supporting member supports a parallel member rotatably with respect to an upper beam. A first brace connects an opposite-end side of the parallel member with an opposite-end side of a lower beam. A second brace connects another opposite-end side of the parallel member with another opposite-end side of the lower beam. An intersection position of the first brace with the second brace is positioned more adjacent to a side of the upper beam than where an intermediate position between the upper beam and the lower beam is present. Damper members dispose respectively so as to be interposed between the parallel member and the upper beam, connecting the parallel member with the upper beam, and being disposed to make a pair at least on both sides each of which is separated away from the rotary supporting member to interpose the rotary supporting member therebetween.

12 Claims, 7 Drawing Sheets

(56) References Cited

U.S. PATENT DOCUMENTS

| | | | | |
|---|---|---|---|---|
| 5,862,638 | A * | 1/1999 | Holland et al. | 52/167.8 |
| 6,695,296 | B1 * | 2/2004 | Runge | 267/160 |
| 6,840,016 | B1 * | 1/2005 | Mualla | 52/167.1 |
| 2010/0251637 | A1 * | 10/2010 | Nishimoto et al. | 52/167.8 |

FOREIGN PATENT DOCUMENTS

| | | | |
|---|---|---|---|
| JP | 2004340301 | A | * 12/2004 |
| JP | 2006-152722 | A | 6/2006 |
| JP | 2007-146437 | A | 6/2007 |
| JP | 2007-211503 | A | 8/2007 |

* cited by examiner

VIBRATION CONTROL DEVICE FOR BEAM-AND-COLUMN FRAME

CROSS-REFERENCE TO RELATED APPLICATIONS

The present Application is a national phase of International Patent Application No. PCT/JP2010/051472 titled "Vibration Control Device for Beam Frame Body," filed Feb. 3, 2010, which claims priority from Japanese Patent Application No. 2009-081222 filed Mar. 30, 2009, the contents of which are incorporated in this disclosure by reference in their entirety.

TECHNICAL FIELD

The present invention is one which relates to a vibration control device for beam-and-column frame.

BACKGROUND ART

As a vibration control device for beam-and-column frame, one which is set forth in Japanese Unexamined Patent Publication (KOKAI) Gazette No. 2003-90,144 (or Patent Literature No. 1) has been heretofore available conventionally. The vibration control device illustrated in FIG. 2 of Patent Literature No. 1 comprises a plastic body being fixed to an upper beam, and a pair of braces connecting this plastic body with a lower beam. That is, it is possible to absorb seismic energies because the plastic body deforms in a case where a beam-and-column frame has deformed horizontally; as a result, it is one which can keep the beam-and-column frame from vibrating.

However, in the constitution according to FIG. 2 of Patent Literature No. 1, one of the braces undergoes tensile deformations, but the other one of the braces undergoes compression deformations, upon the beam-and-column frame undergoing horizontal deformations. That is, it is needed that the braces have rigidity that can withstand the compression deformations. Therefore, there is such a problem that the cross section of the braces should be enlarged.

Here, in FIG. 1 of Patent Literature No. 1, it is devised so as to make compression forces less likely to be applied to the braces. However, it is difficult to produce only shear deformations in the plastic body by this constitution, and so the load-deformation characteristic (e.g., the Q-δ characteristic) at the time of applying repetitive loads horizontally thereto becomes a slippage type (being also referred to as a non-spindle type, or a non-complete elasto-plasticity type, in general).

The "application of repetitive loads" is that the following are repeated: after applying a maximum load in one of the horizontal directions, the aforesaid load is decreased gradually; whereas, another load in the other one of the horizontal directions is increased gradually until the load being applied in the other horizontal direction becomes the maximum load, and then the load being applied in the other horizontal direction is decreased gradually. And, the "slippage type" is a state where a behavior upon decreasing the load being applied in one of the horizontal directions, and another behavior upon increasing the load being applied in the other one of the horizontal directions do not make a continuous behavior, but make a step-shaped, namely, slipped behavior. Moreover, in the case of the slippage type, the behaviors do not become continuous but become stepwise similarly even when the directions of the load applications are reversed contrary to those above.

Note herein that making the load-deformation characteristic at the time of applying repetitive loads into a so-called spindle type (being also referred to as a complete elasto-plasticity type, in general), alternatively, making it approach a spindle type, leads to making the ability of absorbing energies much higher. This is because the restorability becomes favorable by making the characteristic into a spindle type. That is, in the constitution according to FIG. 1 of Patent Literature No. 1, even if it is possible not to make any compression forces act on the braces, the restorability is not favorable because the load-deformation characteristic becomes a slippage type when the plastic body undergoes, in addition to shear deformations, deformations as well in the axial directions of the braces in which tensile forces act.

Moreover, as another vibration control device, one which is illustrated in FIG. 4 of Japanese Unexamined Patent Publication (KOKAI) Gazette No. 2006-152,722 (or Patent Literature No. 2) has been available. The vibration control device according to FIG. 4 of Patent Literature No. 2 is equipped with a fixed plate (23) being disposed upright to a lower beam, two pieces of movable plates (24) being supported swingably so as to interpose the fixed plate (23) therebetween, a pair of braces (5, 6) for connecting the movable plate (24) with an upper beam, a viscoelastic damper (21) being interposed between the fixed plate (23) and the movable plate (24) over the entirety. And, the paired braces (5, 6) intersect with each other adjacent to their middles.

In this constitution, tensile forces and compression forces act alternately on the braces (5, 6), as set forth in paragraph [0016] of Patent Literature No. 2, when horizontal external forces act on a beam-and-column frame. Therefore, it is needed that the braces (5, 6) have rigidity that withstand the acting compression forces. That is, in the same manner as the constitution according to FIG. 2 of Patent Literature No. 1, the constitution being set forth in Patent Literature No. 2 has such a problem that the cross section of the braces should be enlarged.

Furthermore, there is such a fear that the fixed plate (23), and the movable plate (24) undergo such deformations that they pop out in the normal direction with respect to a plane of the beam-and-column frame, when tensile forces or compression forces act on the braces (5, 6). This fear makes one of the causes that the vibration control device declines in the durability. This problem not only arises from the constitutions of the fixed plate and movable plate themselves, namely, their small rigidities against the deformations in the normal direction with respect to a plane of the beam-and-column frame, but also arises from the tensile forces and compression forces that act on the braces (5, 6) alternately.

Patent Literature No. 1: Japanese Unexamined Patent Publication (KOKAI) Gazette No. 2003-90,144; and Patent Literature No. 2: Japanese Unexamined Patent Publication (KOKAI) Gazette No. 2006-152,722

DISCLOSURE OF THE INVENTION

Assignment to be Solved by the Invention

The present invention is one which has been done in view of the circumstances like above, and hence aims at setting up such a constitution that no compression forces act on braces, alternatively, setting up a constitution that makes it possible to make compression forces to be applied to braces smaller extremely; and providing a vibration control device for beam-and-column frame, vibration control device which can demonstrate high vibration control performance.

Means for Solving the Assignment

In order to solve the aforementioned assignment, the present invention is directed to a vibration control device for beam-and-column frame being constituted of beams and columns, and comprises:

a parallel member being disposed inside a frame of said beam-and-column frame, being disposed between a first member and a second member in a manner of separating away from them, the first member and second member facing each other and making one of said beams and said columns, and the parallel member being disposed to parallelly face with respect to said first member;

a rotary supporting member being disposed in a space between said first member and said second member where they face each other, thereby supporting a central section of said first member and that of said parallel member rotatably relatively;

a first brace connecting one of the opposite-end sides of said parallel member with one of the opposite-end sides of said second member or a neighborhood of one of the opposite ends of said second member;

a second brace connecting the other one of the opposite-end sides of said parallel member with the other one of the opposite-end sides of said second member or a neighborhood of the other one of the opposite ends of said second member so as to intersect with said first brace when being viewed from a front of said beam-and-column frame, and being disposed so that a position at which it intersects with said first brace is positioned more adjacent to a side of said first member than where an intermediate position between said first member and said second member is present; and damper members being disposed respectively so as to be interposed between said parallel member and said first member, connecting said parallel member with said first member, and being disposed to make a pair at least on both sides each of which is separated away from said rotary supporting member to interpose said rotary supporting member therebetween.

In accordance with the present invention, the point of intersection between the first brace and the second brace is positioned more adjacent to a side of the first member than is an intermediate position between the first member and the second member when being viewed from a front of the beam-and-column frame. By means of this setup, such a state is established that tensile forces act on one of the first and second braces, neither tensile forces nor compression forces act on the other one of them, alternatively, compression forces or tensile forces act on the other one of them extremely slightly. Thus, it is possible not to make greater compression forces act on the first and second braces.

And, when the direction of horizontal external forces to be applied to the beam-and-column frame changes, one of the braces, which is present on a side that hardly deforms until then, is put in a state of producing tensile forces immediately. Therefore, the load-deformation characteristic (e.g., the Q-δ characteristic) at the time of applying loads repetitively becomes a spindle type. Moreover, even when compression forces act on the other one of the braces, the load-deformation characteristic (e.g., the Q-δ characteristic) becomes a characteristic that approximates a spindle type, because those compression forces act thereon extremely slightly. Therefore, in accordance with the present invention, it is possible to have high restorability, and to demonstrate high vibration controlling performance.

Moreover, in the conventional vibration control devices, the second moment of area of the braces should have been enlarged in order to prevent the braces from being buckled down by means of compression forces that act on the braces. On the contrary, in accordance with the present invention, compression forces hardly act on the braces, as described above. By means of this setup, it is possible to make the second moment of area of the braces smaller extremely. That is, it is possible to intend to downsize the braces. Since it is possible to intend to downsize the braces, it becomes feasible to apply steel rods having comparatively smaller diameters, which are extremely inexpensive, to the braces. Naturally, the assemblability of the braces gets better.

Moreover, the parallel member constituting the present invention is disposed inside a frame of the beam-and-column frame, is disposed between the first member and the second member in a manner of being separated away from them, and is disposed to parallelly face with respect to the first member. Furthermore, the rotary supporting member supports the parallel member and the first member rotatably. In addition, at least a pair of the damper members are disposed between the parallel member and the first member, and on both sides that interpose the rotary supporting member therebetween.

By means of these constitutions, the parallel member swings so as to incline with respect to the first member in a case where horizontal external forces act on the beam-and-column frame. On this occasion, one of the damper members deforms in such a direction that it is crushed down, and the other one of the damper members deforms in such a direction that it elongates. That is, both of the damper members not only demonstrate forces that keep the parallel member from swinging and return the parallel member to swinging, but also demonstrate forces that support the parallel member with respect to the first member. Thus, the parallel member comes to be supported stably, because the damper members, in addition to the rotary supporting member, demonstrate forces for supporting the parallel member.

Note herein that, in the vibration control device being set forth in Patent Literature No. 2, there has been such a problem that the fixed plate and movable plate undergo such deformations that they pop out in the normal direction with respect to a plane of the beam-and-column frame. As one of the causes of this, the compression forces acting on the braces are given. However, in accordance with the present invention, no compression forces act on the braces at all, or only extremely slight compression forces just act on them. Therefore, in the vibration control device according to the present invention, it is possible to inhibit the parallel member from undergoing such deformations that it pops out in the normal direction with respect to a plane of the beam-and-column frame. Furthermore, in accordance with the present invention, the parallel member is supported stably with respect to the first member by means of at least a pair of the damper members, in addition to the rotary supporting member, as described above. Because of this setting as well, it is possible to inhibit the parallel member from undergoing such deformations that it pops out in the normal direction with respect to a plane of the beam-and-column frame.

Moreover, in the present invention, it is fine that said damper members can be damper members being made of steel material. Among dampers, steel-material dampers can be molded relatively inexpensively and with ease. Therefore, it is possible to make costs lower, and to enhance the degree of freedom in designing.

Moreover, in the present invention, it is fine that said damper members can be damper members being made of steel material, damper members which undergo bending deformations in a case where said first member and said parallel member incline as being accompanied by deformations of said beam-and-column frame. By means of this setup, it is possible to securely set up the following at desired positions: a yield point in a case where the damper members deform so as to crush down; and another yield point in a case where the damper members deform so as to elongate.

Note that, in addition to steel-material dampers that undergo bending deformations, steel-material dampers that undergo compression-tension deformations exist. For example, a steel-material damper that undergoes compression-tension deformations is formed as a rectangular parallelepiped shape or a cylindrical shape, and is provided with an opposite end so as to be fixed to the parallel member and with another opposite end so as to be fixed to the first member. Surely, even such a steel-material damper that undergoes compression-tension deformations is applicable. In this case, however, since the characteristic upon undergoing compression deformations differs from the characteristic upon undergoing tension deformations, it is not possible to say that it is easy to set up the following at desired positions: a yield point in a case where the damper members deform so as to crush down; and another yield point in a case where the damper members deform so as to elongate.

Moreover, it is preferable to apply steel-material dampers as the damper members, as described above. However, in addition to the above, it is also possible to apply dampers, and the like, in which rubbers, noncompressive fluids (such as oils, for instance), and so forth, are used.

Moreover, in the present invention, it is fine that said damper members can be formed as a letter-U-shaped configuration opening toward said rotary supporting member, or as another letter-U-shaped configuration opening toward an opposite side to said rotary supporting member. By means of this setup, deformations that arise in the damper members become bending deformations mainly, alternatively become bending deformations alone completely. Therefore, it is possible to stably deform the damper members, and so it is possible to obtain desired yield points.

Note herein that a "letter-U-shaped configuration" is made of paired parallel flat-plate sections, and an arc-like curved section connecting them. That is, it is a configuration that does not have any squared or angled section. By forming the damper members as a letter-U-shaped configuration thusly, it is possible to avoid stress concentration resulting from the configuration of the damper members, and so it is possible to intend to upgrade the fatigue strength, and the like, of steel material.

To the damper members, it is even possible to apply squared or angled configurations that approximate a letter-U shape, in addition to the letter-U-shaped configuration. For example, the following are available: a configuration that has an opening at the long-side section in a pentagon with a home-base shaped configuration, a configuration with a letter-V shape, and the like. In this instance, it is possible to demonstrate the advantageous effects sufficiently, although there might arise such a fear that stress concentration occurs at the squared or angled sections forming the apexes of the pentagon or at the corner of the letter-V shape, compared with a letter-U-shaped configuration, when the damper members undergo bending deformations. Note that it is more preferable that the damper members can be formed as a letter-U-shaped configuration, respectively.

Moreover, in the present invention, it is fine that said damper members can comprise; a first damper member with said letter-U-shaped configuration; and a second damper member being accommodated inside the letter-U shape of the first damper member, and being disposed in a letter-U-shaped configuration so as to open in an identical direction. That is, a dual letter-U-shaped configuration is formed by means of the first damper member and second damper member. By means of this setup, it is possible to further enhance the rigidity for supporting the parallel member, rigidity which results from the damper members. Note that, in a case where it is desired to set up the rigidity for supporting the parallel member higher, it is effective to make the damper members dually, because the rigidity, which results from the damper members, leads to suitably adjusting the aforesaid supporting rigidity.

In a case where the damper members are thus formed as a dual letter-U-shaped configuration, it is even possible to replace each of the damper members with a letter-U-shaped configuration by those with a polygonal squared or angled configuration, or those with a letter-V-shaped configuration. However, from the viewpoint of stress concentration, forming the damper members as a letter-U-shaped configuration is more preferable than the latter.

Moreover, in the present invention, it is fine that said parallel member can comprise:

a parallel flat plate being disposed to parallelly face with respect to said first member and separate away therefrom; and at least one rib-shaped member being disposed upright on one of the sides of said parallel flat plate adjacent to a side of said second member so as to extend in a direction that crosses a rotational axis of said rotary supporting member orthogonally; and one of the opposite ends of said first brace, and one of the opposite ends of said second brace can be connected rotatably to the same one of said rib-shaped members.

By means of this setup, it is possible for the parallel member to stably swing about a rotational axis of the rotary supporting member when horizontal external forces act on the beam-and-column frame. That is, it is possible to inhibit the parallel member from undergoing torsional deformations with respect to the first member. As a result, it is possible to inhibit torsional loads from being applied to the rotary supporting member. In other words, even if the rotary supporting member is not enhanced so much in the supporting rigidity with respect to torsion, it can carry out the supporting action sufficiently. Therefore, it is possible to intend to simplify the rotary supporting member in the construction, and to make it lightweight.

Moreover, in the present invention, it is fine that said first brace, and said second brace can be installed in such a condition that a tensile load has been applied thereto in advance.

In accordance with this setup, even if forces should have acted on the first and second braces in such directions that they undergo compressions slightly when the beam-and-column frame undergoes deformations, it is possible not to put the first and second braces in compression states by applying a tensile load to the first and second braces in advance. Therefore, it is possible to securely turn the load-deformation characteristic (e.g. the Q-δ characteristic) into a spindle type, and hence a stable state can be demonstrated as the vibration control performance.

EXPLANATION ON REFERENCE NUMERALS

Figure 1:
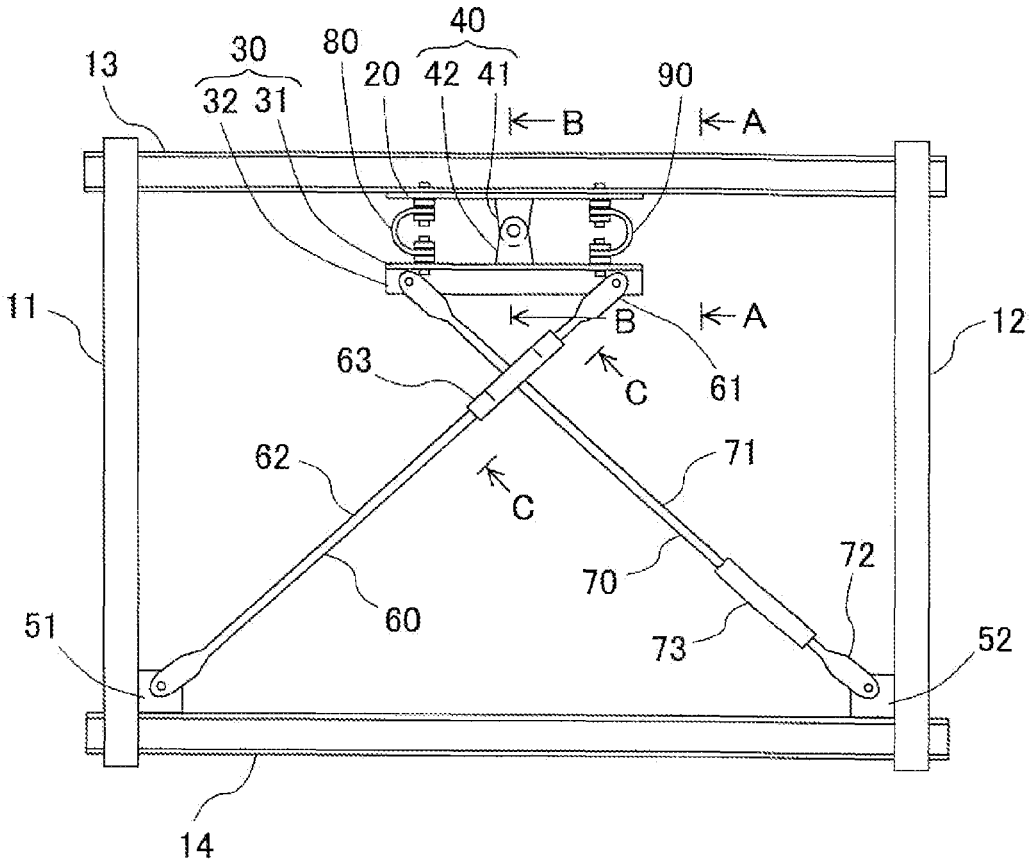
FIG. 1 is a diagram that illustrates a First Embodiment Mode, namely, a vibration control device for beam-and-column frame.
Figure 2:
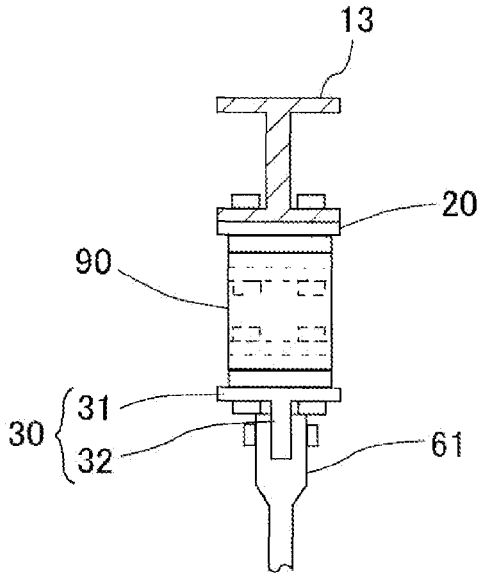
FIG. 2 is an enlarged diagram of the "A"-"A" cross section in FIG. 1.

11, and 12: Columns;
13, and 14: Beams;
20: Installation Plate;
30, and 330: Parallel Members;
31: Parallel Flat Plate;
32: Rib-shaped Member;
40, and 340: Rotary Supporting Members;
41, and 341: Fixed-side Members;
42, and 342: Movable-side Members;
60, and 360: First Braces;
61, 62, 361, and 362: Rods;
63: Crossing Turnbuckle;
70, and 370: Second Braces;
71, 72, 371, and 372: Rods;
73, 363, and 373: Turnbuckles;
(80, 90), (180, 190), and (280, and 290); Damper Members;
281, and 291: First Damper Members;
282, and 292: Second Damper Members;
332: First Rib-shaped Member;
333: Second Rib-shaped Member; and
364, 365, 374, and 375: Ring Joints

MODES FOR CARRYING OUT THE INVENTION

Hereinafter, explanations will be made on embodiment modes that embody a vibration control device according to the present invention while referring to the drawings.

First Embodiment Mode

Explanations will be made on a vibration control device for beam-and-column frame according to a First Embodiment Mode with reference to FIG. 1 through FIG. 4. As illustrated in FIG. 1, a beam-and-column frame forms a rectangularly-framed shape. Specifically, the beam-and-column frame is made up of a pair of columns (11, 12) being disposed parallelly at a predetermined distance away from one another, an upper beam 12 connecting the upper ends of the paired columns (11, 12) with each other, and a lower beam 14 being disposed to face to the upper beam 12 and connecting the lower ends of the paired columns (11, 12) with each other. Here, the columns (11, 12) are a square-section steel-pipe column, respectively, and the upper beam 13 and the lower beam 14 are an H-section steel beam, respectively. Note herein that, although a steel construction is given as an example as for the beam-and-column frame, the present embodiment mode is also applicable to lightweight steel constructions and wooden framework constructions in addition to the former. Moreover, in the present embodiment mode, the upper beam 13 corresponds to the first member according to the present invention, and the lower beam 14 corresponds to the second member according to the present invention.

The present vibration control device for beam-and-column frame comprises an installation plate 20, a parallel member 30, a rotary supporting member 40, first and second gasset plates (51, 52), a first brace 60, a second brace 70, and a pair of damper members (80, 90).

The installation plate 20 comprises a rectangular flat plate being made of metal. This installation plate 20 is fixed directly to the upper beam 13 in such a state that it comes in contact with the lower face of the upper beam 13. This installation plate 20 is a plate for installing the rotary supporting member 40 and the paired damper members (80, 90) thereon. That is, the installation plate 20 functions as a reinforcement material for the upper beam 13, and becomes integral with the upper beam 13. Therefore, this installation plate 20 is one which corresponds to a part of the first member according to the present invention virtually. Moreover, on both of the right and left ends of the installation plate 20 in FIG. 1, through holes are formed in a quantity of two pieces for each of them. These through holes are those into which bolts are inserted, bolts which are for fixing the paired damper members (80, 90) being described later. Note that, in the upper beam 13, through holes are formed similarly so as to communicate with the aforesaid through holes.

Figure 3:
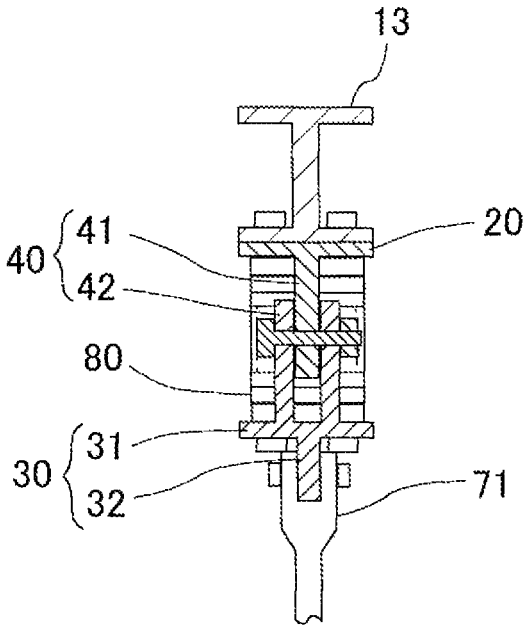
FIG. 3 is an enlarged diagram of the "B"-"B" cross section in FIG. 1.

The parallel member 30 is disposed inside a frame of the beam-and-column frame, is disposed between the upper beam 13 and the lower beam 14 in a manner of separating away from them, and is disposed to parallelly face with respect to the upper beam 13. As illustrated in FIG. 1 and FIG. 3, this parallel member 30 is made up of a parallel flat plate 31, and one and only rib-shaped member 32.

The parallel flat plate 31 comprises a rectangular metallic flat plate that is the same as that for the installation plate 20 substantially. This parallel flat plate 31 is disposed so that it separates away from and faces parallelly with respect to the installation plate 20 to be fixed to the upper beam 13. On both of the right and left ends of this parallel flat plate 31 in FIG. 1, through holes are formed in a quantity of two pieces for each of them. These through holes are those into which bolts are inserted, bolts which are for fixing the paired damper members (80, 90) being described later.

The rib-shaped member 32 is disposed upright at the middle of the parallel flat plate 31 substantially in the minor-axis-wise direction on one of the opposite faces of the parallel flat plate 31, namely, on the lower face of the parallel flat plate 31 (or the face adjacent to a side of the lower beam 14), so as to extend in a direction in parallel to the beams (13, 14). This rib-shaped member 32 is welded to the parallel flat plate 31. Here, the "direction in parallel to the beams (13, 14)" is a direction that is the same as a direction that orthogonally crosses a rotational axis of the rotary supporting member 40 being described later. On both of the right and left ends of this rib-shaped member 32 in FIG. 1, a through hole is formed in a quantity of one piece for each of them. Into these through holes, pins are inserted, pins which are for rotatably supporting the first and second braces (60, 70) being described later.

As illustrated in FIG. 1, the rotary supporting member 40 is disposed in a space between the installation plate 20 and the parallel member 30 where they face each other, thereby supporting a central section of the installation plate 20 in FIG. 1 and a central section of the parallel member 30 in FIG. 1 rotatably relatively. Specifically, the rotary supporting member 40 is made up of a fixed-side member 41 being welded to the installation plate 20 so as to be integral with it, and two pieces of movable-side members 42 being welded to the upper face of the parallel flat plate 31 so as to be integral with it, and facing mutually. And, the fixed-side member 41 is disposed between the two movable-side members 42 so as to be interposed between them, and is joined with the two by a pin. That is, with respect to the fixed-side member 41, the two movable-side members 42 become rotatable about the normal-axis direction to the sheet face of FIG. 1. Thus, the rotary supporting member 40 makes the parallel member 30 rotatable, with respect to the upper beam 13, in which the normal direction to the sheet face of FIG. 1 serves as the rotational axis.

The first gasset plate 51 comprises a flat plate with a through hole formed, and is welded to the left-side column 11 in FIG. 1 and to the left end of the lower beam 14. The second gasset plate 52 comprises a flat plate with a through hole formed, and is welded to the right-side column 12 in FIG. 1 and to the right end of the lower beam 14. In addition to having a function as a member for connecting the first and second braces (60, 70), the first and second gasset plates (51, 52) have a function of enhancing the strength of the connections between the columns (11, 12) and the lower beam 14.

Figure 4:
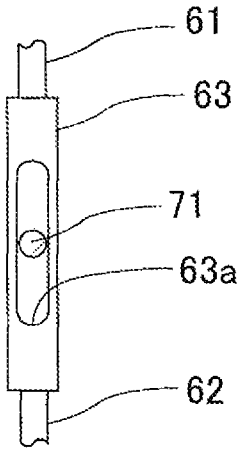
FIG. 4 is an enlarged diagram of the "C"-"C" cross section in FIG. 1.

The first brace 60 connects the right opposite-end side of the rib-shaped member 32 in FIG. 1 with the first gasset plate 51. This first brace 60 is made up of first and second rods (61, 62) having a forked end at one of the ends, and a crossing turnbuckle 63 for linearly connecting another end of the first rod 61 with another end of the second rod 62. Parts of the first and second rods (61, 62) other than the forked ends comprise a steel rod having a circular cross section, respectively. And, the forked end of the first rod 61 is joined to the through hole of the rib-shaped member 32 on the right opposite-end side in FIG. 1 by a pin so that the first rod 61 becomes rotatable with respect to the rib-shaped member 32. Moreover, the forked end of the second rod 62 is joined to the through hole of the first gasset plate 51 by a pin so that the second rod 62 becomes rotatable with respect to the first gasset plate 51. Moreover, as illustrated in FIG. 4, the crossing turnbuckle 63 is provided with a through hole 63*a* in the middle, and is screwed together to the first and second rods (61, 62) at the opposite ends.

The second brace 70 connects the left opposite-end side of the rib-shaped member 32 in FIG. 1 with the second gasset plate 52. This second brace 70 is made up of first and second rods (71, 72) having a forked end at one of the ends, and a crossing turnbuckle 73 for linearly connecting another end of the first rod 71 with another end of the second rod 72. Parts of the first and second rods (71, 72) other than the forked ends comprise a steel rod having a circular cross section, respectively. And, the forked end of the first rod 71 is joined to the through hole of the rib-shaped member 32 on the left opposite-end side in FIG. 1 by a pin so that the first rod 71 becomes rotatable with respect to the rib-shaped member 32. Furthermore, this first rod 71 penetrates through the through hole 63*a* of the crossing turnbuckle 63. Moreover, the forked end of the second rod 72 is joined to the through hole of the second gasset plate 52 by a pin so that the second rod 72 becomes rotatable with respect to the second gasset plate 52. Moreover, to the opposite ends of the turnbuckle 73, the other ends of the first and second rods (71, 72) are screwed together, respectively.

That is, the first brace 60, and the second brace 70 cross one another when being viewed from a front of the beam-and-column frame. And, this crossing position is disposed so as to be more adjacent to a side of the upper beam 13, namely, more adjacent to a side of the parallel member 30, than where the intermediate position between the upper beam 13 and the lower beam 14 is present. Moreover, the first brace 60 and second brace 70 are installed under such a condition that a tensile load has been applied to them slightly in advance.

The paired damper members (80, 90) are disposed so that they are interposed between the installation plate 20 and the parallel flat plate 31, and are disposed respectively on both sides, which interpose the rotary supporting member 40, while being separated respectively away from the rotary supporting member 40 by an equal distance. And, the paired damper members (80, 90) connect the installation plate 20 with the parallel flat plate 31. Specifically, they connect each of the opposite ends in the installation plate 20 with each of the opposite ends in the parallel flat plate 31.

These paired damper members (80, 90) comprise a damper member, which undergoes bending deformations in a case where the upper beam 13 and the parallel flat plate 31 incline as being accompanied by deformations of the beam-and-column frame, respectively. Specifically, as illustrated in FIG. 1, the paired damper members (80, 90) are formed as a letter-U-shaped configuration that opens toward the rotary supporting member 40. Here, the "letter-U-shaped configuration" is made up of a pair of parallel flat-plate sections, and an arc-like curved section connecting them. That is, the damper members (80, 90) have a configuration that does not have any squared or angled section. Forming the damper members (80, 90) as a letter-U-shaped configuration thusly makes it possible to avoid stress concentration resulting from the configuration of the damper members (80, 90), and makes it possible to intend to upgrade the fatigue strength, and the like, of steel material.

These paired damper members (80, 90) have such an extent of width (i.e., the width in the right/left direction in FIG. 2) that is substantially the same as a width of the installation plate 20 and parallel flat plate 31 (i.e., the width in the right/left direction in FIG. 2), alternatively, such an extent of width that is slightly shorter than the latter. That is, the paired dampers (80, 90) have an ample width, respectively. And, an end of the letter-U shape is fixed to the installation plate 20 and upper beam 13 by means of a bolt, and another end of the letter-U shape is fixed to the parallel flat plate 31. Note that, in the present embodiment mode, a seat plate intervenes between the damper members (80, 90) and the installation plate 20, and another seat plate intervenes between the damper members (80, 90) and the parallel flat plate 31. This is because a yielding point of the damper members (80, 90) has been adjusted so as to be a desired value.

That is, in a case where the parallel flat plate 31 inclines with respect to the upper beam 13, namely, in a case where deformations occur so that the separation distance between an end of the parallel flat plate 31 and an end of the installation plate 20 becomes smaller, the damper member 80, which is fixed to the aforesaid ends, undergo bending deformations so that it crushes down in the up/down direction in FIG. 1. On the other hand, in a case where deformations occur so that the separation distance between another end of the parallel flat plate 31 and another end of the installation plate 20 becomes bigger, the damper member 90, which is fixed to the aforesaid other ends, undergo bending deformations so that it elongates in the up/down direction in FIG. 1.

Figure 5:
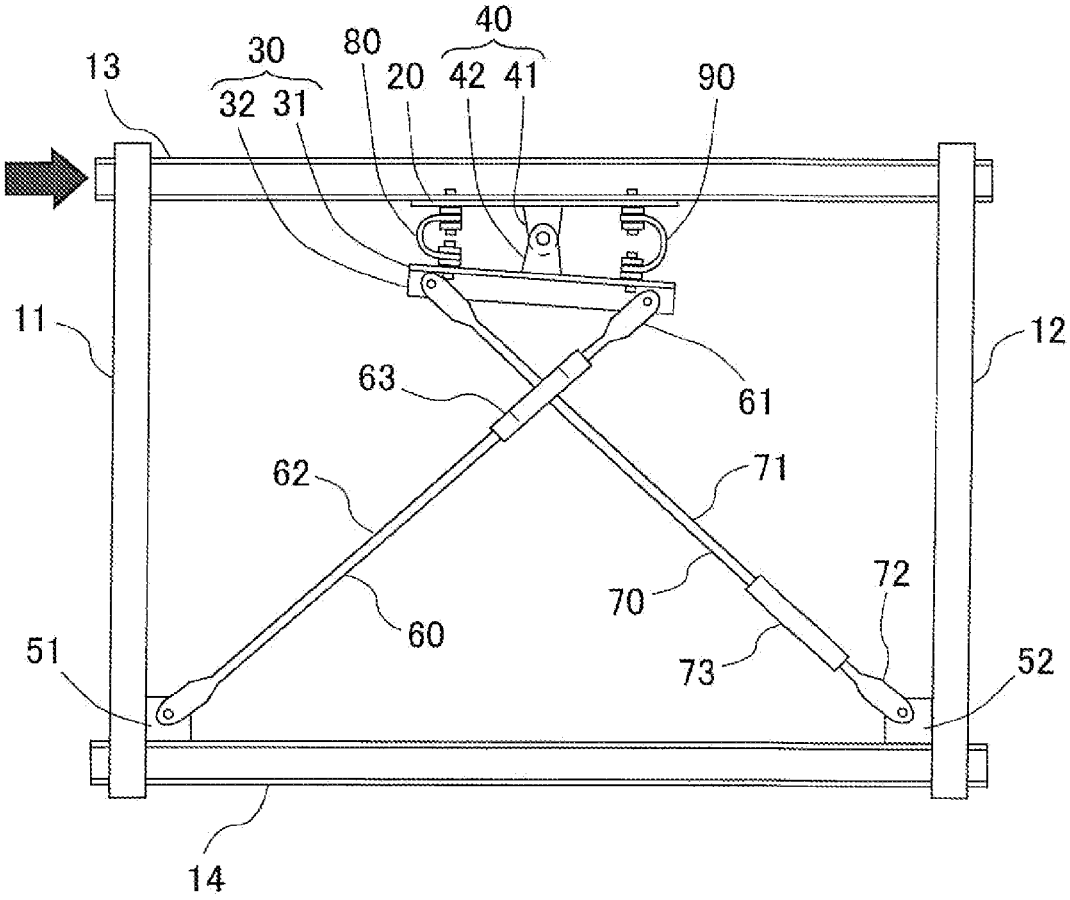
FIG. 5 is a diagram on such a circumstance that a horizontal external force is applied to a beam-and-column frame.

Next, explanations will be made on operations of the above-described vibration control device for beam-and-column frame with reference to FIG. 5. In a case where horizontal forces act with respect to a beam-and-column frame, the beam-and-column frame tries to deform so as to be parallelograms. Here, in order to make explanations easier, let us consider a case where a horizontal force acts on the connection between the left-side column 11 in FIG. 1 and the upper beam 13 in the rightward direction in FIG. 1, as illustrated in FIG. 5.

On this occasion, the parallel member 30 tries to move relatively with respect to the lower beam 14 toward the right side in FIG. 1. Therefore, the first brace 60 comes to receive a tensile force from the supporting points at the opposite ends. Because of this, the first brace 60 pulls the right end of the parallel member 30 in FIG. 1 toward the first gasset plate 51. Due to the tensile force resulting from the first brace 60, the parallel member 30 tries to rotate about a rotary axis of the rotary supporting member 90 serving as the center in the clockwise direction (or right-wise) in FIG. 1.

As being accompanied by this right-wise rotation of the parallel flat plate 30, the left end of the parallel member 30 tries to move toward the upper side in FIG. 1. Due to this operation, the length of the second brace 70 hardly changes. That is, compression forces or tensile forces scarcely act on the second brace 70. Thus, the first brace 60 comes to receive tensile forces, but the second brace 70 comes to barely receive loads. Such a behavior is effected, because the intersection point between the first brace 60 and the second brace 70 is positioned more adjacent to a side of the upper beam 13 than is the intermediate point between the upper beam 13 and the lower beam 14 when being viewed from a front of the beam-and-column frame.

Note, however, that compression loads might possibly be applied to the second brace 70, but extremely slightly, depending on cases. But, in addition to that such compression forces arise extremely slightly, since the second brace 70 is installed after a tensile load has been applied to it in advance, the second brace 70 does not at all come to undergo compression deformations in the first place.

And, since the first brace 60 undergoes tensile deformations thusly, a resistant power against earthquakes is demonstrated in a case where horizontal forces act on the beam-and-column frame.

Since the vibration control device for beam-and-column frame according to the present embodiment mode further comprises the paired damper members (80, 90), it demonstrates an advantageous effect of controlling vibrations, in addition to the resistant power against earthquakes. Explanations will be made on this advantage in detail. As described above, in a case where a horizontal force acts on a beam-and-column frame, the parallel member 30 rotates with respect to the upper beam 13 about a rotary axis of the rotary supporting member 40 that makes the center. By means of this operation, the separation distance between the left end of the parallel flat plate 31 in FIG. 1 and the left end of the installation plate 20 becomes smaller. Accordingly, one of the damper members, the damper member 80, undergoes bending deformations so as to be crushed down. On the other hand, the separation distance between the right end of the parallel flat plate 31 in FIG. 1 and the right end of the installation plate 20 becomes bigger. Consequently, the other one of the dampers, the damper member 90, undergoes bending deformations so as to elongate. Because of the bending deformations of the damper members (80, 90), the steel material forming the damper members (80, 90) yields to undergo plastic deformations. By means of these operations, seismic energies are absorbed, and thereby an effect of controlling vibrations is demonstrated.

After the paired damper members (80, 90) undergo bending deformations, they demonstrate such a force that they return back to the original states. That is, the damper members (80, 90) produce forces that put the parallel member 30 in a state of being parallel to the upper beam 13.

Figure 6:
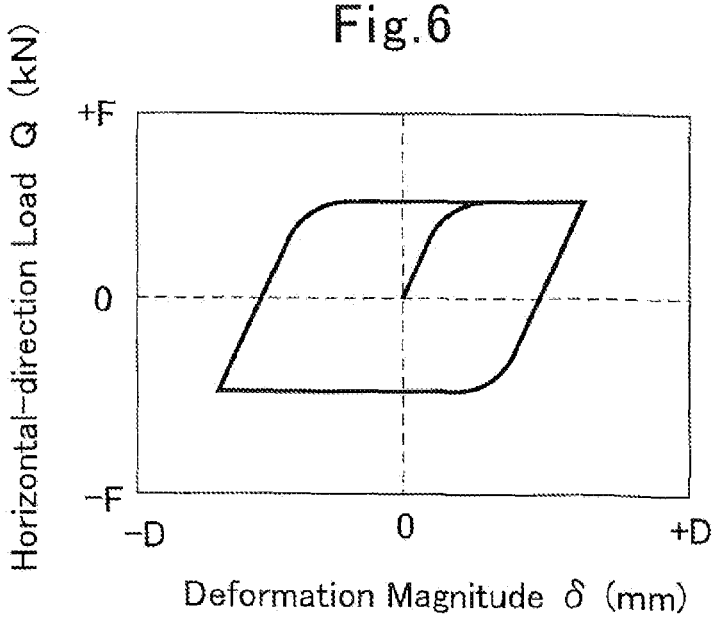
FIG. 6 is a diagram that shows a load-deformation characteristic (e.g., the Q-δ characteristic)

An experiment in which horizontal forces were applied repeatedly with respect to this vibration control device for beam-and-column frame was carried out, thereby obtaining a load-deformation characteristic (e.g., a Q-δ characteristic). The load-deformation characteristic in the vibration control device for beam-and-column frame according to the present embodiment mode made a so-called spindle type, as illustrated in FIG. 6.

An observation on the reasons for the above will be described. In accordance with the present embodiment mode, the crossing point between the first brace 60 and the second brace 70 is positioned more adjacent to a side of the first member than is the intermediate point between the upper beam 13 and the lower beam 14, as described above, when being viewed from a front of the beam-and-column frame. By means of this setup, compression forces hardly act on the first and second braces (60, 70) in a case where horizontally vibrating external forces act on the beam-and-column frame. Furthermore, even if compression forces should have acted on the first and second braces (60, 70), the aforesaid compression forces fall within a range of the tensile load that has been applied to the first and second braces (60, 70) in advance because they are extremely slight in the magnitude. As a result, it is possible to have tensile forces alone acting on the first and second braces (60, 70) virtually.

Due to the above, one of the braces that has hardly changed until then is put in such a state that it produces tensile forces immediately when the directions of horizontal external forces to be applied to the beam-and-column frame change. Therefore, it is believed that the load-deformation characteristic (e.g., the Q-δ characteristic) at the time of applying loads repetitively turns into a spindle type. Since it is possible to thusly turn the load-deformation characteristic into a spindle type, the restorability becomes favorable with respect to repetitive loads, and thereby it is possible to demonstrate extremely high vibration control performance. Note that, since such circumstances have arisen that greater compression forces act on the braces or no elastic forces are demonstrated during the time period till tensile forces act on the other one of the braces, it is believed that it has been heretofore impossible to make a spindle type conventionally.

Moreover, in accordance with the vibration control device according to the present embodiment mode, since no compression forces act on the first and second braces (60, 70), or since only slight compression forces alone act on them, it is possible to make the second moment of area of the first and second braces (60, 70) smaller extremely. That is, it is possible to intend to downsize the first and second braces (60, 70). Furthermore, making it possible to intend to downsize the first and second braces (60, 70) makes it feasible to apply steel rods having smaller wire diameters, which are extremely inexpensive, to the first and second braces (60, 70), and hence the assemblability of the first and second braces (60, 70) gets better.

Furthermore, since the paired damper members (80, 90) are installed as aforementioned, the paired damper members (80, 90) demonstrate forces for supporting the parallel member 30 with respect to the upper beam 13, in addition to forces that keep the parallel member 30 from swinging and return the parallel member 30 to swinging. Therefore, the parallel member 30 comes to be supported stably, because the paired damper members (80, 90), in addition to the rotary supporting member 40, demonstrate forces for supporting the parallel member 30. Therefore, it is possible to inhibit the parallel member 30 from undergoing such deformations that it pops out in the normal direction with respect to a framed flat face of the beam-and-column frame. In addition, compression forces hardly act on the first and second braces (70, 80), as described above. Because of this setting as well, it is possible to inhibit the parallel member 30 from undergoing such deformations that it pops out in the normal direction with respect to a framed flat face of the beam-and-column frame.

Moreover, it is possible to intend to make costs lower, and to enhance the degree of freedom in designing, by means of employing steel-material damper members as the damper members (80, 90). In addition, the following can be securely set up at desired positions by adapting steel-material dampers being capable of undergoing bending deformations into the damper members (80, 90): a yield point in a case where the damper members (80, 90) deform so as to crush down; and another yield point in a case where the damper members (80, 90) deform so as to elongate.

Moreover, due to the setup that the parallel member 30 constitutes the rib-shaped member 32, the rib-shaped member 32 comes to have a function of reinforcing the parallel flat plate 31. And, due to the setup that the first and second braces (60, 70) are connected to the identical rib-shaped member 32, the parallel member comes to be able to stably swing about a rotational axis of the rotary supporting member 40. That is, it is possible to inhibit the parallel member 30 from undergoing torsional deformations with respect to the upper beam 13. As a result, it is possible to inhibit torsional loads from being applied to the rotary supporting member 40. In other words, even if the rotary supporting member 40 is not enhanced so much in the supporting rigidity with respect to torsion, it can carry out the supporting action sufficiently. Therefore, it is possible to intend to simplify the rotary supporting member 40 in the construction, and to make it lightweight.

Modified Modes of First Embodiment Mode

Next, explanations will be made on modified modes of the vibration control device for beam-and-column frame according to the First Embodiment Mode, namely, on two types of them, for instance. Specifically, only the paired damper members (80, 90) are altered.

Figure 7:
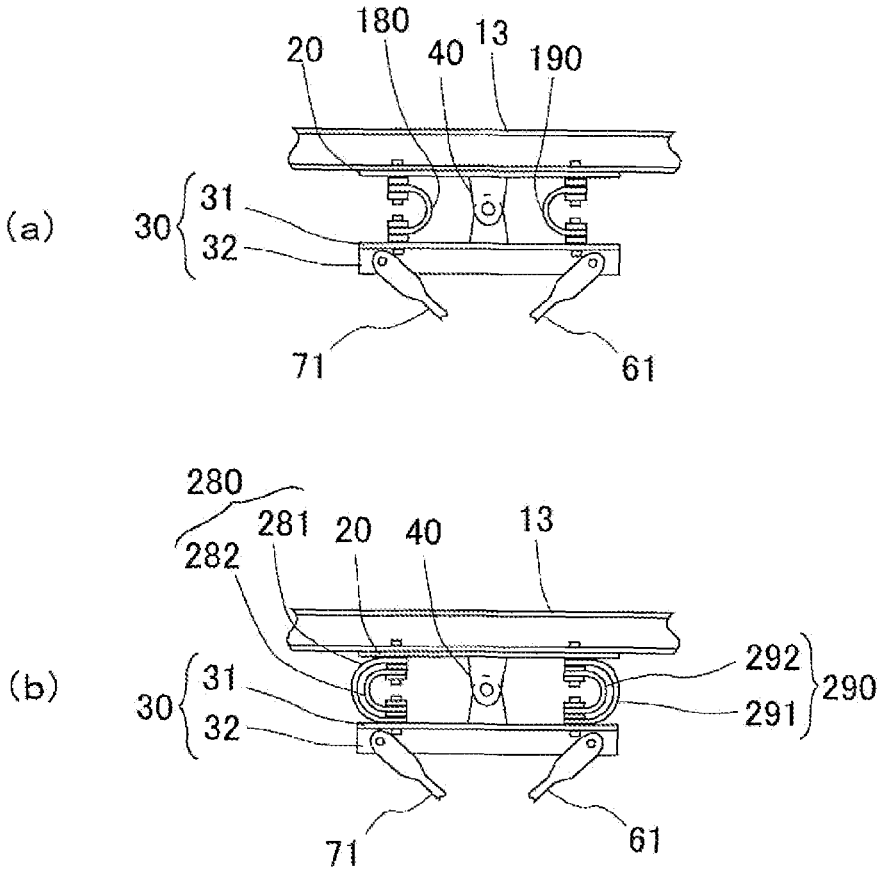
FIG. 7 is a diagram that illustrates a modified mode of the vibration control device for beam-and-column frame according to the First Embodiment Mode.

In FIG. 7(*a*), a pair of damper members (180, 190) serving as a First Modified Mode are illustrated. These paired damper members (180, 190) are formed as a letter-U-shaped configuration that opens toward the opposite sides to the rotary supporting member 40, respectively. That is, although the aforesaid paired dampers (180, 190) are formed as the same configuration as that of the damper members (80, 90) according to the First Embodiment Mode, but differ from them in the installation directions.

In this instance as well, the same advantages as those of the First Embodiment Mode can be effected virtually. However, since the supporting rigidity and yield points of the damper members (180, 190) are distinct, it is possible to selectively use the constitution according to the First Embodiment Mode and the constitution of the aforesaid First Modified Mode when adjusting the supporting rigidity and yield points suitably so as to be desired values.

Moreover, in FIG. 7(*b*), a pair of damper members (280, 290) serving as a Second Modified Mode are illustrated. That is, the paired damper members (280, 290) are made up of first damper members (281, 291) with a letter-U-shaped configuration, and second damper members (282, 292) being accommodated inside the letter-U shape of the first damper members (281, 291), and being disposed in a letter-U-shaped configuration so as to open in the same direction as does the former, respectively. In other words, a dual letter-U-shaped configuration is formed by means of the first damper members (281, 291) and second damper members (282, 292). By means of this setup, it is possible to more enhance the rigidity for supporting the parallel member 30, rigidity which results from the damper members (280, 290).

Second Embodiment Mode

Figure 9:
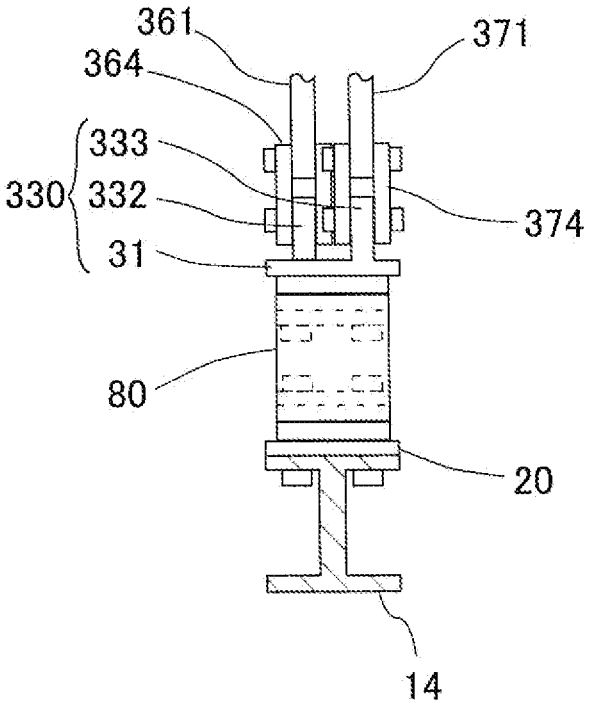
FIG. 9 is an enlarged diagram of the "D"-"D" cross section in FIG. 8.
Figure 10:
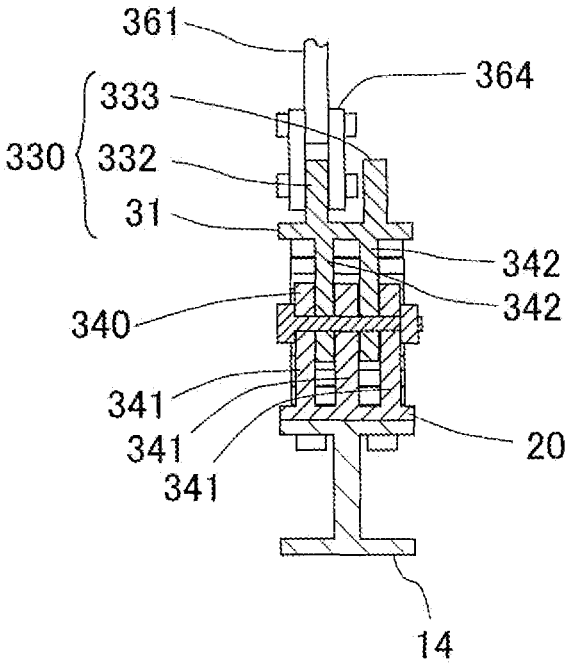
FIG. 10 is an enlarged diagram of the "E"-"E" cross section in FIG. 8.

Next, explanations will be made on a vibration control device for beam-and-column frame according to a Second Embodiment Mode with reference to FIG. 8 through FIG. 10. The vibration control device for beam-and-column frame according to the Second Embodiment Mode comprises an installation plate 20, a parallel member 330, a rotary supporting member 340, first and second gasset plates (51, 52), a first brace 360, a second brace 370, and a pair of damper members (80, 90). Here, the aforesaid vibration control device according to the Second Embodiment Mode is installed to a beam-and-column frame in a state of being inverted upside down, with respect to the vibration control device according to the First Embodiment Mode. Hereinafter, explanations will be made only on constitutions of the vibration control device according to the Second Embodiment Mode alone that are distinct from those of the vibration control device according to the First Embodiment Mode.

The parallel member 330 is disposed inside a frame of the beam-and-column frame, is disposed between the upper beam 13 and the lower beam 14 to separate away from them, and is disposed to parallelly face with respect to the lower beam 14. As illustrated in FIG. 8 through FIG. 10, this parallel member 330 is made up of a parallel flat plate 31, and two rib-shaped members (332, 333).

Since the parallel flat plate 31 is identical with that of the First Embodiment Mode, explanations thereon will be omitted. The rib-shaped members (332, 333) are disposed upright on one of the opposite faces of the parallel flat plate 31, namely, on the upper face of the parallel flat plate 31 (or the face adjacent to a side of the upper beam 13), so as to extend in a direction in parallel to the beams (13, 14). The first rib-shaped member 332 is disposed on a section of the upper face of the parallel flat plate 31, section which extends from the left end in FIG. 8 up to the vicinity of the middle in the right/left direction in FIG. 8, and which is present on a more leftward side slightly than is the middle in the right/left direction in FIG. 9 and FIG. 10. At the left end of this first rib-shaped member 332 in FIG. 8, a through hole is formed in a quantity of one piece. Into this through hole, a pin is inserted, pin which is for rotatably supporting the first brace 360. Meanwhile, the second rib-shaped member 333 is disposed on another section of the upper face of the parallel flat plate 31, another section which extends from the right end in FIG. 8 up to the vicinity of the middle in the right/left direction in FIG. 8, and which is present on a more rightward side slightly than is the middle in the right/left direction in FIG. 9 and FIG. 10. At the right end of this second rib-shaped member 333 in FIG. 8, another through hole is formed in a quantity of one piece. Into this through hole, another pin is inserted, another pin which is for rotatably supporting the second brace 370.

Figure 8:
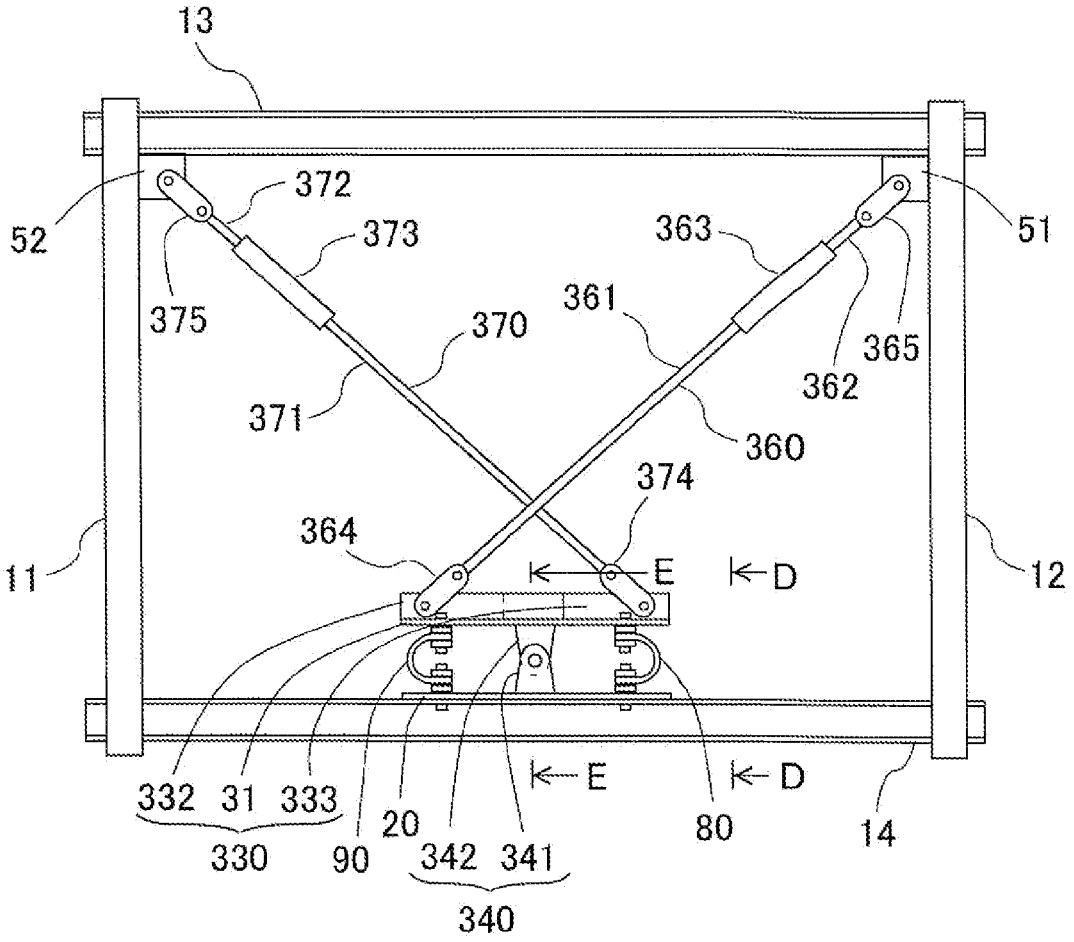
FIG. 8 is a diagram that illustrates a Second Embodiment Mode, namely, another vibration control device for beam-and-column frame.

The first brace 360 connects the left opposite-end side of the first rib-shaped member 332 in FIG. 8 with the first gasset plate 51. This first brace 360 is made up of first and second rods (361, 362), a turnbuckle 363 for linearly connecting an end of the first rod 361 with an end of the second rod 362, a first ring joint 364 being disposed rotatably to another end of the first rod 361, and a second ring joint 365 being disposed rotatably to another end of the second rod 362. And, the first ring joint 364 is joined rotatably to the through hole of the first rib-shaped member 332. The second ring joint 365 is joined rotatably to the through hole of the first gasset plate 51. That is, in the first brace 360, since the first and second ring joints (364, 365) become swingable, it is possible to make no compression forces act on the first and second rods (361, 362) as well as on the turnbuckle 363 at all completely.

The second brace 370 connects the right opposite-end side of the second rib-shaped member 333 in FIG. 8 with the second gasset plate 52. This second brace 370 is made up of first and second rods (371, 372), a turnbuckle 373 for linearly connecting an end of the first rod 371 with an end of the second rod 372, a first ring joint 374 being disposed rotatably to another end of the first rod 371, and a second ring joint 375 being disposed rotatably to another end of the second rod 372. And, the first ring joint 374 is joined rotatably to the through hole of the first rib-shaped member 332. The second ring joint 375 is joined rotatably to the through hole of the second gasset plate 52. That is, in the second brace 370, since the first and second ring joints (374, 375) become swingable, it is possible to make no compression forces act on the first and second rods (371, 372) as well as on the turnbuckle 373 at all completely.

Here, the first brace 360, and the second brace 370 are displaced one another when being viewed from the rightward direction in FIG. 8. This is because the first rib-shaped member 332 and second rib-shaped members 333 are disposed so that they displace one another in the front/rear direction in FIG. 8. Because they are set up in such a constitution, it becomes unnecessary to use crossing turnbuckles, unlike the First Embodiment Mode.

However, since the first brace 360 and the second brace 370 are displaced one another in the front/rear direction in FIG. 8, there might be such a fear that the parallel member 30 deforms so as to twist with respect to the lower beam 14 in a case where horizontal external forces act on the beam-and-column frame.

Hence, the rotary supporting member 340 is made so that the supporting rigidity becomes higher compared with that according to the First Embodiment Mode. Specifically, as illustrated in FIG. 10, a constituent element of the rotary supporting member 340, a movable-side member 342 to be fixed onto the parallel member 330, comprises two pieces of plates that face one another in the front/rear direction in FIG. 8 but separate away from each other therein. Meanwhile, another constituent element of the rotary supporting member 340, a fixed-side member 341 to be fixed onto the installation plate 20, comprises three pieces of plates that face one another in the front/rear direction in FIG. 8 but separate away from each other therein. And, the fixed-side members 341, and the movable-side members 342 are arranged alternately so that one of the latter is interposed between two of the former, or vice versa.

Note that, in addition to the advantageous effects that the aforementioned distinct features produce, the present embodiment mode also produces the same advantageous effects as those of the First Embodiment Mode.

<Others>

In the aforementioned embodiment modes, an example is given, example in which the parallel member 30 or 330 is installed to the upper beam 13 or the lower beam 14 by way of the rotary supporting member 40 or 340. In addition to this, even when a parallel member is made so as to be installed to the column 11 or 12, it is possible to produce a substantially similar vibration controlling effect. That is, this makes such a state that the vibration control device according to FIG. 1 is rotated by 90°.

Moreover, in the aforementioned embodiment modes, although the damper members (80, 90), (180, 190) and (280, 290) are formed as a letter-U-shaped configuration, they shall not be limited to this setup. For example, to the damper members (80, 90), (180, 190) and (280, 290), it is even possible to apply squared or angled configurations that approximate a letter-U shape, in addition to the letter-U-shaped configuration. For example, the following are available: a configuration that has an opening at the long-side section in a pentagon with a home-base shaped configuration, a configuration with a letter-V shape, and the like. In this instance, it is possible to demonstrate the advantageous effects sufficiently, although there might arise such a fear that stress concentration occurs at the squared or angled sections forming the apexes of the pentagon, compared with a letter-U-shaped configuration, when the damper members (80, 90), (180, 190) and (280, 290) undergo bending deformations. Note that it is more preferable that the damper members (80, 90), (180, 190) and (280, 290) can be formed as a letter-U-shaped configuration, respectively.

The invention claimed is:

1. A vibration control device for a beam-and-column frame being constituted of beams and columns, the device comprising:

a parallel member being disposed inside the frame of said beam-and-column frame, being disposed between a first member and a second member in a manner of separating away from said first member and said second member, the first member and second member facing each other, the parallel member and the second member having opposite side ends, and the parallel member being disposed to parallelly face with respect to said first member;

a rotary supporting member being disposed in a space between said first member and said second member, thereby supporting a central section of said first member and that of said parallel member rotatably relatively;

a first brace connecting one of the opposite-end sides of said parallel member with one of the opposite-end sides of said second member or a neighborhood of one of the opposite ends of said second member;

a second brace connecting the other one of the opposite-end sides of said parallel member with the other one of the opposite-end sides of said second member or a neighborhood of the other one of the opposite ends of said second member so as to intersect with said first brace when being viewed from a front of said beam-and-column frame, and being disposed so that a position at which said second brace intersects with said first brace is positioned more adjacent to a side of said first member than where an intermediate position between said first member and said second member is present; and damper members being disposed respectively so as to be interposed between said parallel member and said first member, connecting said parallel member with said first member, and being disposed to make a pair at least on both sides each of which is separated away from said rotary supporting member to interpose said rotary supporting member therebetween.

2. The vibration control device for beam-and-column frame according to claim 1, wherein said damper members are made of steel material.

3. The vibration control device for beam-and-column frame according to claim 2, wherein said damper members which undergo bending deformations in a case where said first member and said parallel member incline as being accompanied by deformations of said beam-and-column frame.

4. The vibration control device for beam-and-column frame according to claim 2, wherein said damper members are formed as a letter U-shaped configuration opening toward said rotary supporting member, or as another letter U-shaped configuration opening toward an opposite side to said rotary supporting member.

5. The vibration control device for beam-and-column frame according to claim 4, wherein said damper members comprise a first damper member with said letter U-shaped configuration; and a second damper member being accommodated inside the letter U-shaped of the first damper member, and being disposed in a letter U-shaped configuration so as to open in an identical direction.

6. The vibration control device for beam-and-column frame according to claim 1, wherein said parallel member comprises:

a parallel flat plate being disposed to parallelly face with respect to said first member and separate away therefrom; and at least one rib member being disposed upright on one of the sides of said parallel flat plate adjacent to a side of said second member so as to extend in a direction that crosses a rotational axis of said rotary supporting member orthogonally; and one of the opposite ends of said first brace, and one of the opposite ends of said second brace are connected rotatably to the same one of said rib members.

7. A vibration control device for a beam-and-column frame being constituted of beams and columns, the device comprising:

a parallel member being disposed inside the frame of said beam-and-column frame, being disposed between a first member and a second member in a manner of separating away from said first member and said second member, the first member and second member facing each other, the parallel member and the second member having opposite side ends, and the parallel member being disposed to parallelly face with respect to said first member, the parallel member further comprising a parallel flat plate being disposed to parallelly face said first member and separate away therefrom, at least one rib member being disposed upright on one of the sides of said parallel flat plate adjacent to a side of said second member so as to extend in a direction that crosses a rotational axis of a rotary supporting member orthogonally, and one of the opposite ends of said first brace, and one of the opposite ends of said second brace are connected rotatably to the same one of said rib members;

said rotary supporting member being disposed in a space between said first member and said second member, thereby supporting a central section of said first member and that of said parallel member rotatably relatively;

a first brace connecting one of the opposite-end sides of said parallel member with one of the opposite-end sides of said second member or a neighborhood of one of the opposite ends of said second member;

a second brace connecting the other one of the opposite-end sides of said parallel member with the other one of the opposite-end sides of said second member or a neighborhood of the other one of the opposite ends of said second member so as to intersect with said first brace when being viewed from a front of said beam-and-column frame, and being disposed so that a position at which said second brace intersects with said first brace is positioned more adjacent to a side of said first member than where an intermediate position between said first member and said second member is present; and steel damper members formed as a letter U-shaped configuration opening toward said rotary supporting member being disposed respectively so as to be interposed between said parallel member and said first member, connecting said parallel member with said first member, and being disposed to make a pair at least on both sides each of which is separated away from said rotary supporting member to interpose said rotary supporting member therebetween, wherein the damper members undergo bending deformations in a case where said first member and said parallel member incline as being accompanied by deformations of said beam-and-column frame.

8. A vibration control device for a beam-and-column frame being constituted of beams and columns, the device comprising:

a parallel member being disposed inside the frame of said beam-and-column frame, being disposed between a first member and a second member in a manner of separating away from said first member and said second member, the first member and second member facing each other, the parallel member and the second member having opposite side ends, and the parallel member being disposed to parallelly face with respect to said first member;

a rotary supporting member being disposed in a space between said first member and said second member, thereby supporting a central section of said first member and that of said parallel member rotatably relatively;

a first brace connecting one of the opposite-end sides of said parallel member with one of the opposite-end sides of said second member or a neighborhood of one of the opposite ends of said second member;

a second brace connecting the other one of the opposite-end sides of said parallel member with the other one of the opposite-end sides of said second member or a neighborhood of the other one of the opposite ends of said second member so as to intersect with said first brace when being viewed from a front of said beam-and-column frame, and being disposed so that a position at which said second brace intersects with said first brace is positioned more adjacent to a side of said first member than where an intermediate position between said first member and said second member is present, wherein said first brace and said second brace are installed in such a condition that a tensile load has been applied thereto in advance; and damper members being disposed respectively so as to be interposed between said parallel member and said first member, connecting said parallel member with said first member, and being disposed to make a pair at least on both sides each of which is separated away from said rotary supporting member to interpose said rotary supporting member therebetween.

9. A vibration control device for a frame, wherein the frame comprises a beam-and-column frame, the device comprising:

a parallel member disposed inside the frame, wherein the parallel member is disposed between a first beam member and a second beam member and the parallel member is disposed parallel to the first beam member;

a rotary support member being disposed between the first beam member and the parallel member, wherein the rotary support member is connected to the first beam member and the parallel member;

one or more damper members connectively disposed between the parallel member and the first beam member;

a first brace connecting a first end of the parallel member with an opposite side of the second beam member; and a second brace connecting a second end of the parallel member with an opposite side of the second beam member so as to intersect with the first brace, the intersection of the first and second braces being positioned closer to the first beam member than the second beam member.

10. A vibration control device for a frame according to claim 9, wherein the first brace and the second brace are installed in such a condition that a tensile load has been applied thereto in advance.

11. A vibration control device for a frame according to claim 9, wherein the one or more damper members are made of steel material.

12. A vibration control device for a frame according to claim 9, wherein the one or more dampers comprise a letter U-shaped configuration opening toward the rotary support member.

* * * * *